US005896608A

United States Patent [19]

Whatley

[11] Patent Number: 5,896,608

[45] Date of Patent: Apr. 27, 1999

[54] FOOTWEAR LASTING COMPONENT

[76] Inventor: Ian H. Whatley, 5630 SE. Gladstone, Portland, Oreg. 97206

[21] Appl. No.: 08/813,603

[22] Filed: Mar. 7, 1997

Related U.S. Application Data

[63] Continuation-in-part of application No. 08/337,607, Nov. 10, 1994, abandoned.

[51] Int. Cl.[6] ..... A43B 13/28

[52] U.S. Cl. ..... 12/142 T; 12/145; 36/12

[58] Field of Search ..... 12/142 T, 145, 12/146 L; 36/12, 23

[56] References Cited

U.S. PATENT DOCUMENTS

| | | | |
|---|---|---|---|
| 309,055 | 7/1884 | Whatley . | |
| 401,060 | 4/1889 | Pillow | 36/43 X |
| 490,998 | 1/1893 | Trice | 36/43 |
| 1,058,561 | 4/1913 | Davis | 36/170 |
| 1,258,629 | 3/1918 | Bliss | 36/170 X |
| 1,286,787 | 12/1918 | Rokahr . | |
| 1,602,675 | 10/1926 | Hurley . | |
| 1,637,897 | 8/1927 | Eddins . | |
| 2,070,116 | 2/1937 | Cutillo . | |
| 2,147,197 | 2/1939 | Glidden . | |
| 2,358,474 | 9/1944 | Pope | 36/170 X |
| 2,530,637 | 11/1950 | Taylor | 36/170 |
| 2,539,761 | 1/1951 | Whitman | 36/170 X |
| 2,591,211 | 4/1952 | Spencer | 36/170 X |
| 2,798,309 | 7/1957 | Wustemann | 36/170 |
| 2,850,813 | 9/1958 | Williamee . | |
| 3,323,232 | 6/1967 | Danowsky . | |
| 3,464,125 | 9/1969 | Conway . | |
| 3,854,228 | 12/1974 | Conroy . | |
| 4,107,857 | 8/1978 | Devlin . | |
| 4,132,016 | 1/1979 | Vaccari . | |
| 4,150,455 | 4/1979 | Fukuoka . | |
| 4,253,251 | 3/1981 | Salomon . | |
| 4,322,895 | 4/1982 | Hockerson . | |
| 4,342,161 | 8/1982 | Schmohl . | |
| 4,542,598 | 9/1985 | Misevich et al. . | |
| 4,550,511 | 11/1985 | Gamm . | |
| 4,622,764 | 11/1986 | Boulier | 36/69 X |
| 4,627,177 | 12/1986 | Meyers . | |
| 4,706,316 | 11/1987 | Tanzi . | |
| 4,736,531 | 4/1988 | Richard . | |
| 4,854,057 | 8/1989 | Misevich et al. . | |
| 4,922,630 | 5/1990 | Robinson . | |
| 4,924,605 | 5/1990 | Spademan . | |
| 4,947,560 | 8/1990 | Fuerst et al. . | |
| 5,060,401 | 10/1991 | Whatley . | |
| 5,323,549 | 6/1994 | Segel et al. . | |
| 5,339,544 | 8/1994 | Caberlotto . | |

FOREIGN PATENT DOCUMENTS

| | | | |
|---|---|---|---|
| 0478322 | 1/1938 | United Kingdom | 36/170 |
| 0512449 | 6/1940 | United Kingdom | 36/170 |
| 0526630 | 9/1940 | United Kingdom | 36/170 |

OTHER PUBLICATIONS

*Athletic Footwear,* pp. 140–141, 144–146.

*Manual of Shoemaking,* C&J Clark Ltd., pp. 205–207 (1976).

*The Pattern Cutter's Handbook,* pp. 118, 119, 122.

*Primary Examiner*—Ted Kavanaugh

*Attorney, Agent, or Firm*—Lyon & Lyon LLP

[57] ABSTRACT

The invention relates in part to a method of constructing a lasting board with contiguous attachment points. A flexible shoe lasting board is formed with extensions beyond the feather edge of the last. The extensions are coextensively formed with the lasting board since they are cut as a single unit from one sheet of material. This method of construction provides greater integrity of the joint between board and extensions than would be present if attachment was required, such as by stitching or cementing. The extensions of the lasting board are useful for securing the shoe to the foot and for securing components to the lasting board.

18 Claims, 10 Drawing Sheets

FOOTWEAR LASTING COMPONENT

RELATED APPLICATIONS

This application is a continuation-in-part of Whatley U.S. Ser. No. 08/337,607, filed Nov. 10, 1994, now abandoned, entitled "Footweaer Lasting Component" hereby incorporated by reference herein in its entirety.

BACKGROUND OF THE INVENTION

The following description of the background of the invention is provided to aid in understanding the invention, but is not admitted to describe or constitute prior art to the invention.

The invention relates in part to a component for the attachment of a sole to an upper to form an article of footwear.

Footwear generally consists of a flexible open bag (known as an upper) for fixing about the foot of a wearer, and a sole attached below the upper. The sole may include an element designed to attenuate shock, generally referred to as a midsole. The sole may also include an element designed for ground engagement, generally referred to as an outsole.

Several methods of attaching an upper to a sole have been developed. In slip lasting, force lasting or tubular construction, a upper is generally extended below the feather edge of the last and stitched to itself to form a bag. In this construction, no lasting board is present. In California slip lasting a lasting board, sometimes called a slip-sock, is stitched to the edges of the upper below the feather edge of the last. The upper is held in shape about the last while a sole is attached.

In string lasting, the upper is drawn about a last by pulling two strings stitched to the lower margin of the upper. The action of gathering the lower margin of the upper below the featherline is followed by the application of a sole to maintain the shoe shape prior to removal of the last. A lasting board is rarely used in this construction. When present, it is used as a rigidity—providing sheet element lying inside the feather edges of the last.

In flat lasting, a lasting board is placed along some portion of the bottom of the last inside the feather edges. The upper is drawn over the last and the lower margin wrapped onto the lasting board where it is secured with cement, stitching, staples, nails, tacks or rivets. A sole is attached to the upper and the last removed.

Moccasin construction uses a lasting board, sometimes called a shankboard, in the heel area inside the feather edges of the last with upper material wrapped under the forefoot. As in other methods, a sole is attached by cementing, stitching, direct injection, vulcanizing, molding or nailing before the last is removed. Rib lasting, flange lasting and Goodyear welt lasting all involve attaching the upper to a flat rigid welt board for attachment to a sole unit usually by cement, stitching or stapling.

These methods of using lasting boards to attach sole and upper elements are shown in art on footwear, for example, Whatley U.S. Pat. No. DES. 309,055 shows a shoe constructed by flat lasting with cement. Several variations on these constructions are taught by the following art.

Conroy U.S. Pat. No. 3,854,228 discloses an inflatable footwear component which includes a linking tube that passes below the last during shoe construction.

Devlin U.S. Pat. No. 4,107,857 discloses a shoe construction in which upper straps are wrapped below a lasting board for attachment.

Fukuoka U.S. Pat. No. 4,150,455 discloses a method for manufacturing footwear in which sole elements are directly injected onto uppers with or without lasting boards present.

Hockerson U.S. Pat. No. 4,322,895 discloses a method of wrapping a foam midsole onto the upper above the feather edge.

Misevich U.S. Pat. No. 4,542,598 discloses a shoe with two separate sole units attached to an upper with a lasting board.

Meyers U.S. Pat. No. 4,627,177 discloses an insert to be placed in a shoe above the lasting board.

Richard U.S. Pat. No. 4,736,531 discloses a shoe construction in which an elastic upper element is wrapped below a lasting board.

Misevich U.S. Pat. No. 4,854,057 discloses a board for inclusion within a sole to alter the torsional rigidity of the shoe.

Robinson U.S. Pat. No. 4,922,630 discloses an ankle support strap for attachment by wrapping below a lasting board or attachment to an upper.

Spademan U.S. Pat. No. 4,924,605 discloses a shock absorbing system which may be attached above or below a lasting board.

Fuerst U.S. Pat. No. 4,947,560 discloses a shoe construction in which a sole is wrapped onto the upper and secured with stitching.

Whatley U.S. Pat. No. 5,060,401 discloses a cushioning element which may be attached between the lasted upper and the sole unit with or without the presence of a lasting board.

The following publication and U.S. patents provide disclosure that aid the interpretation of the present invention: Rokahr, U.S. Pat. No. 1,286,787 (issued Dec. 3, 1918); Hurley, U.S. Pat. No. 1,602,675 (issued Oct. 14, 1922); Eddins, U.S. Pat. No. 1,637,897 (issued Aug. 2, 1927); Cutillo, U.S. Pat. No. 2,070,116 (issued Feb. 9, 1937); Glidden, U.S. Pat. No. 2,147,197 (issued Feb. 14, 1939); Williamee, U.S. Pat. No. 2,850,813 (issued Sep. 9, 1958); Danowsky, U.S. Pat. No. 3,323,232 (issued Jun. 6, 1967); Conway, U.S. Pat. No. 3,464,125 (issued Sep. 2, 1969); Vaccari, U.S. Pat. No. 4,132,016 (issued Jan. 2, 1979); Salomon, U.S. Pat. No. 4,253,251 (issued Mar. 3, 1981); Schmohl, U.S. Pat. No. 4,342,161 (issued Aug. 3, 1982); Gamm, U.S. Pat. No. 4,550,511 (issued Nov. 5, 1985); Tanzi, U.S. Pat. No. 4,706,316 (issued Nov. 17, 1987); Caberlotto, U.S. Pat. No. 5,339,544 (issued Aug. 23, 1994); and Segel et al., U.S. Pat. No. 5,323,549 (issued Jun. 28, 1994).

SUMMARY OF THE INVENTION

The invention features a component for the manufacture of footwear. This component is a modified lasting board in which extensions are provided beyond the usual feather edge of the board. The board is used in the usual manner to aid in fastening an upper and a sole together about a last, but provides several unique advantages.

Thus, in a first aspect, the invention features an article of footwear having an upper and a sole. A modified lasting board is also provided to draw the upper about the last for attachment of the sole. The lasting board is formed from a sheet of material. The lasting board material is flexible to permit bending about the feather edge of the last. A layer of textile formed by knitting, weaving or stitch bonding is suitable for the lasting board. Other materials suitable for the board would include rubber, canvas, plastic sheet, nylon or reconstituted leather. The lasting board includes one or more tabs or extensions from its edge. These extensions are coextensively formed from the same sheet of material as the lasting board. This may be achieved by cutting or molding the lasting board to include the extensions. To permit anchoring to these extensions of the lasting board, they should extend at least 3 mm beyond the feather edge of the last and are distinct from mere markers that might be present in existent lasting boards.

The term "coextensively formed" as used herein refers to two or more elements of a construct formed continuously from the same piece of material. For example, a lasting board has a coextensively formed extension when the lasting board and extension are cut from a piece of material as one unit. Another expression of the term "coextensively formed" is that the lasting board and continuous extensions are formed intimately from the same sheet of material. A coextensively formed construction that comprises both a lasting board and one of more extensions obviates the need to attach the extension or extensions to the lasting board by stitching or other connective methods since the two elements (e.g., the lasting board and the extension or extensions) are simply one piece of material.

The lasting board, which may include a coextensively formed extension or extensions, is fixed to the upper by cement, stitching, nails, staples, rivets, direct injection, radio welding, heat welding or solvent bonding. The sole is fixed to the upper and lasting board by cement, stitching, nails, staples, rivets, direct injection, radio welding, heat welding or solvent bonding. The extensions of the lasting board are used as anchor points for components or accessories in the upper such as straps, collars, eyelets, eyestays, buckles, braces, tongues, laces, elastic sections, velcro fasteners, the quarters or the vamp.

A lasting board with an extension or extensions formed intimately from the same sheet of material permits the firm attachment of upper components to the sole. A further benefit of this board is a reduction in the number of steps needed in footwear processing since the step of attaching anchor points below the last's feather edge is no longer required. An additional benefit is the reduction in weight of the shoe since the additional material required to wrap below the lasting board in traditional constructions is no longer required.

The term "sole" is used, as the term is commonly used, to include all those elements of an article of footwear which are attached below the upper. These may typically include such items as a midsole, an outsole, shock attenuating components and stabilizing components.

The term "upper" is used to denote those pieces and components of a shoe that cover the foot above the sole. The upper generally includes a forefoot and heel area and a lasting board may extend only through the forefoot area of the upper.

The term "feather edge" as used herein refers to both the prominent angled border formed at the junction of the generally flat bottom surface of a last where it meets the generally vertical side walls of the last and an imaginary generally vertical projection of this edge below the last. Thus, the feather edge of a lasting board corresponds to the feather edge of the last.

In preferred embodiments, the lasting board is formed by die cutting from a sheet of stitch bonded textile. At least one extension in excess of 3 mm (preferably at least 1–2 cm, or even 5 cm or more) beyond the feather edge of the last is included in the shape cut from the sheet of material. The lasting board is then attached to an upper by stitching to make a California slip lasted pattern. The extension is used as an anchor point for the attachment of components either before lasting the upper or after the sole has been attached and the last removed from the upper. In one embodiment, an eyestay is stitched to the top of the extension to permit firm retention of the foot by laces.

In other preferred embodiments, the lasting board is attached to an upper by cementing, a sole is attached to the combined lasting board and upper and the last removed. The free end of the lasting board extension is then used for the attachment of an ankle brace by riveting.

In other preferred embodiments, there are several extensions from the lasting board; the extensions from the lasting board are passed through slits in the upper; and a hook and loop fastener, such as VELCRO® fastener, is stitched to the extensions of the lasting board to permit additional security of the footwear about the foot; the extensions pass through a hole in the sole.

Other features and advantages of the invention will be apparent from the following description of the preferred embodiments thereof, and from the claims.

DETAILED DESCRIPTION OF THE PREFERRED EMBODIMENTS

Until the invention, attachment of upper components and accessories to a lasting board was a costly and labor intensive process which added weight and caused rough, weak seams that could abrade the foot of the wearer. Previous inventions address this issue by either (i) finding new methods of attachment to the lasting board, (ii) avoiding the use of a lasting board altogether, such as stitched welt constructions, or (iii) avoiding attachment by providing separate support elements.

The present invention overcomes these problems of attaching a lasting board by constructing a lasting board for easy attachment. The invention simplifies the lasting board forming process by constructing the lasting board with coextensively formed extensions, thereby obviating the need to attach these extensions. This simplification improves the durability of the lasting board/upper attachment by replacing upper linings, leather straps, and other materials. Thus, use of the present invention results in a shoe that costs less in materials, weighs less, requires less labor, has no seams, and has increased shoe strength.

A. Lasting Board Construction

Figure 1A:
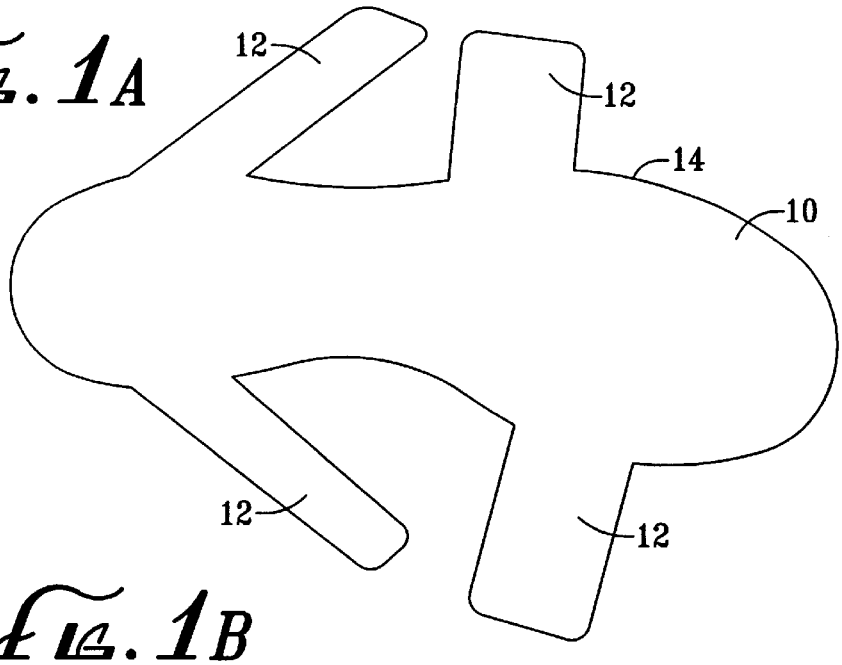
FIGS. 1A and 1C are isometric top views of a lasting board with tabs extending beyond the feather margin (shown in dashed lines).

Referring to FIG. 1A, a lasting board 10 with extensions 12 extending at least 3 mm beyond a feather edge 14 is formed by cutting or molding as a single component for use in footwear.

Figure 1B:
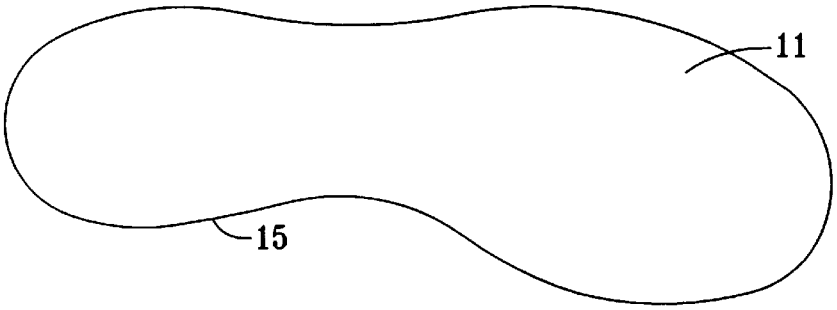
FIGS. 1B and 1D are isometric top views of lasting boards without extensions beyond the feather edge.

Referring to FIG. 1B, a lasting board 11 is shown without the invention of extensions beyond a feather edge 15.

Figure 1C:
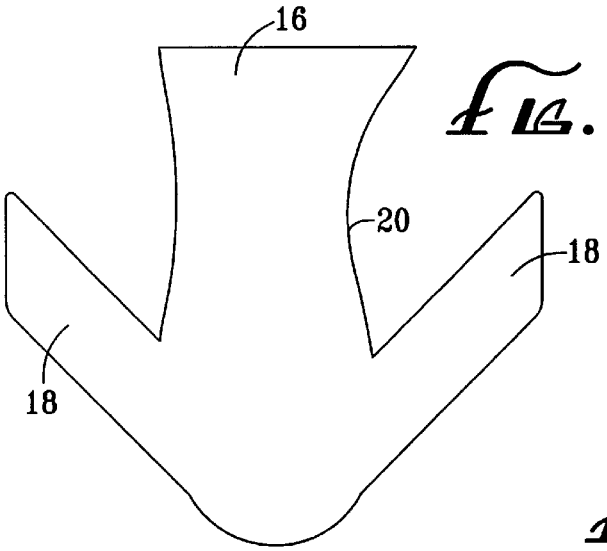

Referring to FIG. 1C, a partial lasting board 16, sometimes called a shank board, is provided with extensions 18 extending at least 3 mm beyond a feather edge 20.

Figure 1D:
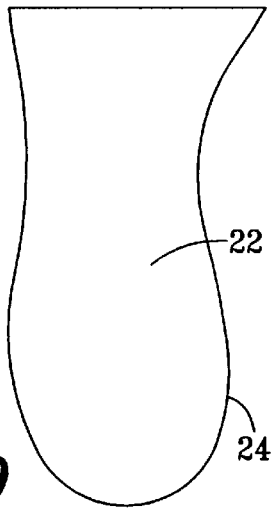

Referring to FIG. 1D, a partial lasting board 22 is shown without the invention of extensions beyond a feather edge 24.

B. Use

Figure 2A:
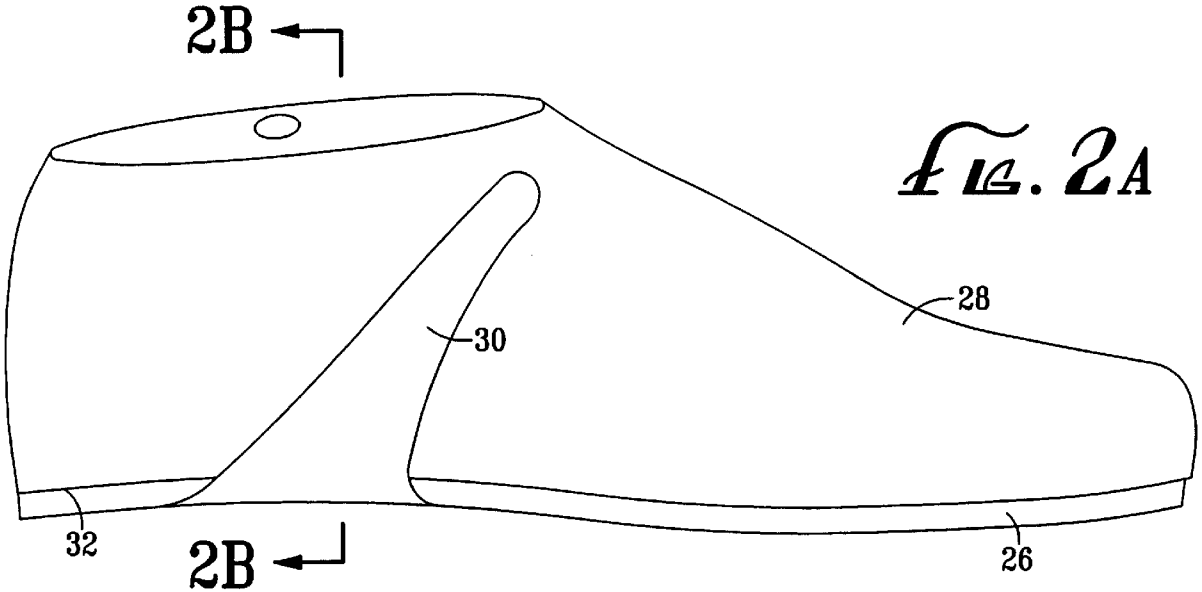
FIG. 2A is an isometric side view of a last having a lasting board with an extension in position for attaching an upper.
Figure 2B:
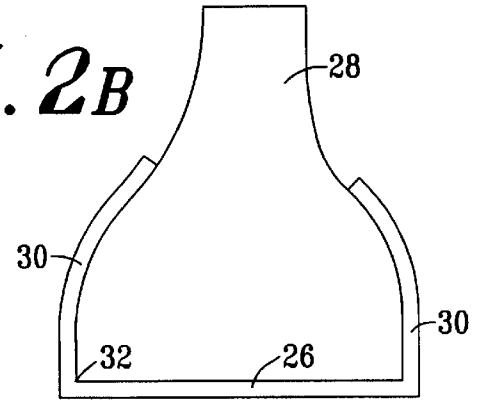
FIG. 2B is a cross-sectional view taken at in FIG. 2A.
Figure 2C:
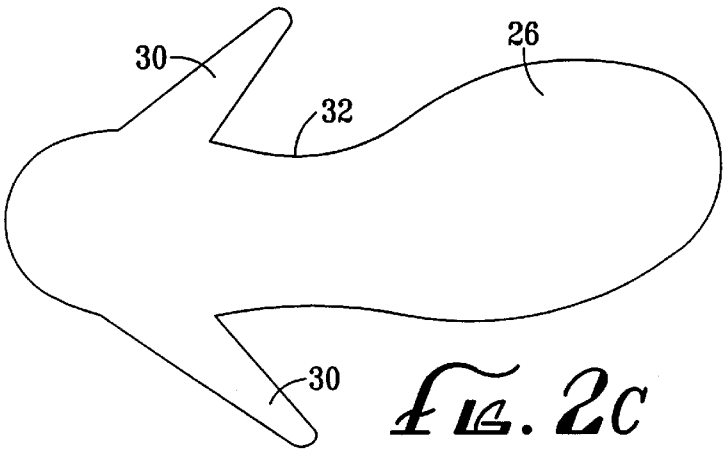
FIG. 2C is an isometric top view of the lasting board of FIG. 2A prior to placement on the last.

Referring to FIGS. 2A, B, C, a lasting board 26 is positioned along the lower surface of a last 28 and lasting board extensions 30 are wrapped above a feather edge 32.

Figures 3A, 3B, 3C:
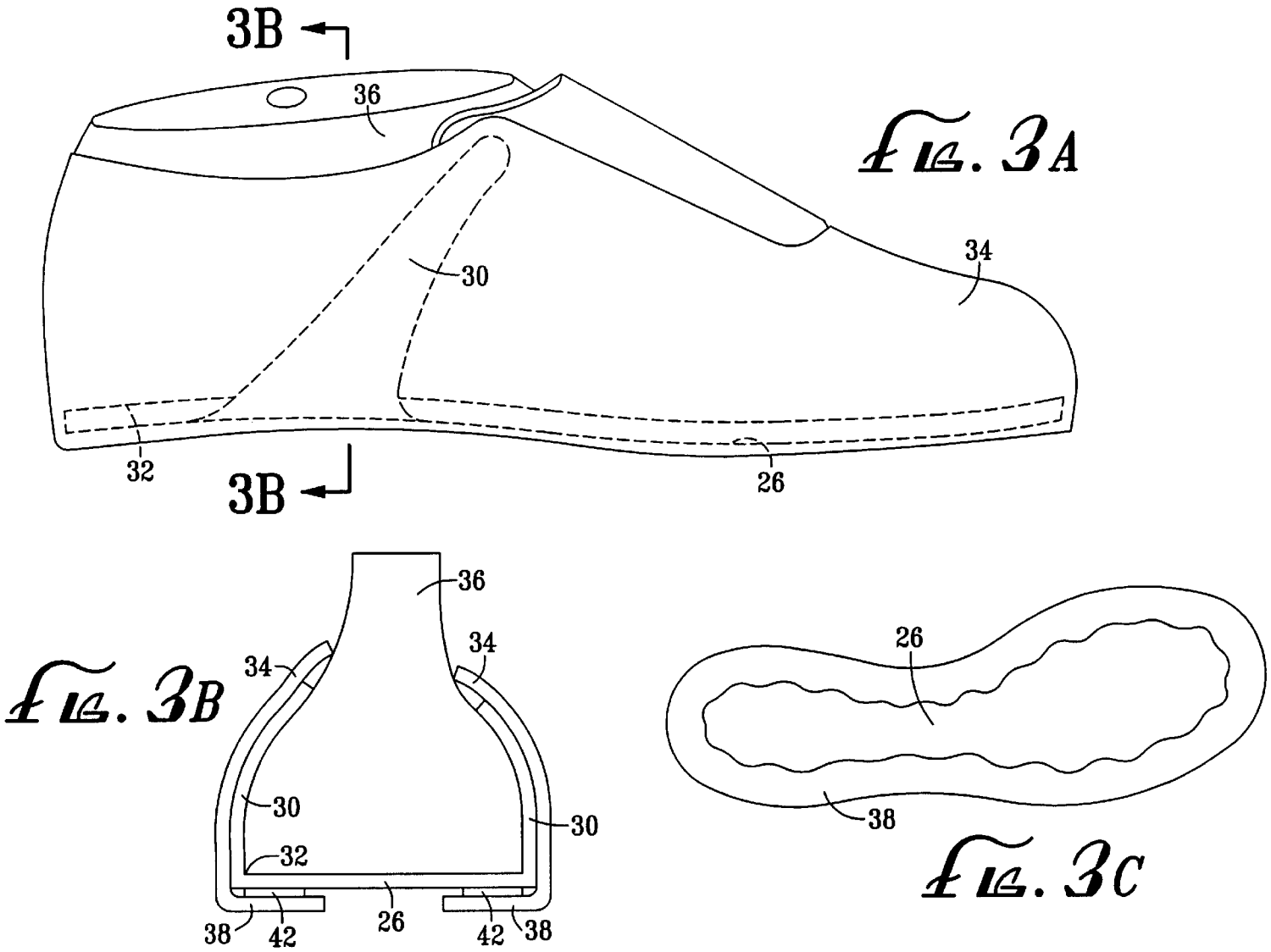
FIG. 3A is an isometric side view of an upper secured about a last having a lasting board with extensions.
FIG. 3B is a cross-sectional view taken at Y in FIG. 3A.
FIG. 3C is a bottom view of the upper and lasting board of FIG. 3A.

Referring to FIGS. 3A, B, C, an upper 34 is placed about last 36 and a lower border 38 is secured to lasting board 26 with cement 42 below feather edge 32. A sole, not shown, may now be applied to the lower surface.

The above extensions of the lasting board may be used as anchor points for any number of finings or accessories. The extensions may be from any part or parts of the feather edge of the lasting board, being useful as anchor points providing that they extend at least 3 mm beyond the feather edge.

C. Other Embodiments

Figure 4A:
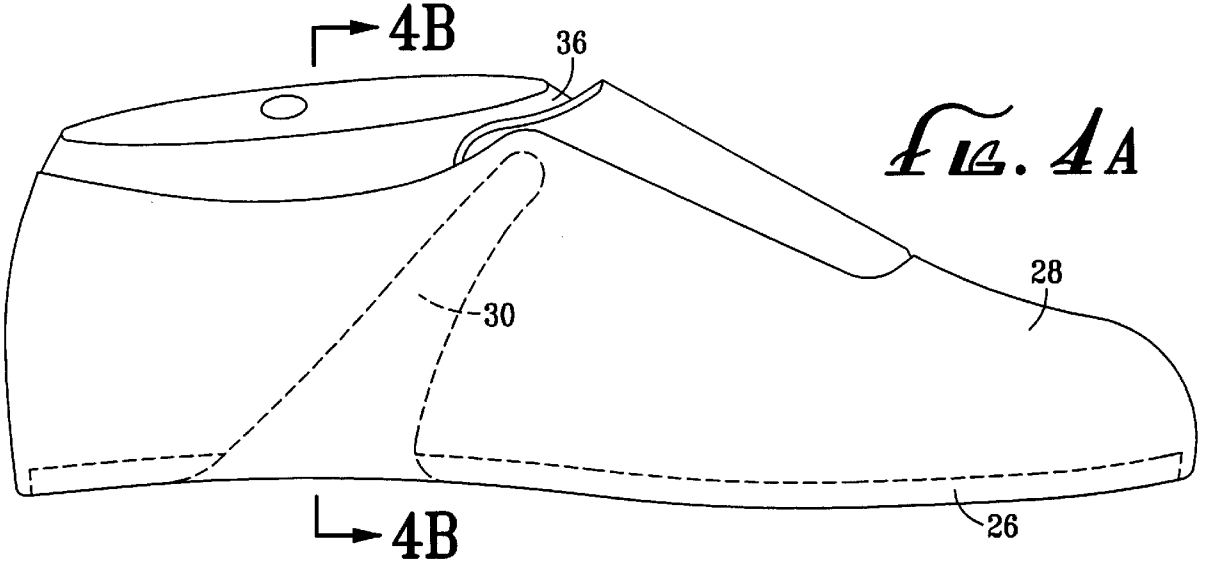
FIG. 4A is an isometric side view of an upper secured about a last having a lasting board with extensions.
Figure 4B:
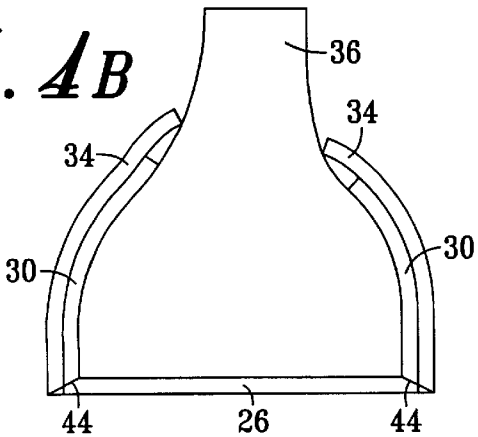
FIG. 4B is a cross-sectional view taken at Z in FIG. 4A.
Figure 4C:
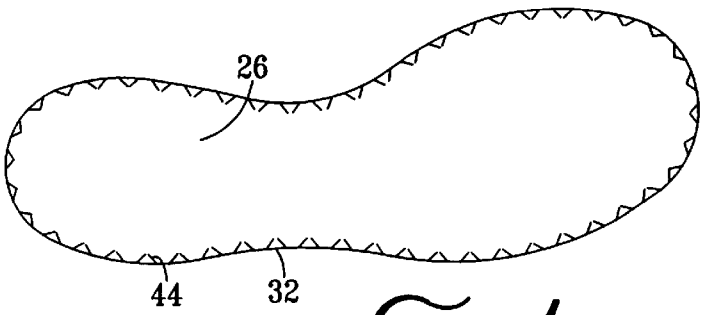
FIG. 4C is a bottom view of the upper and lasting board of FIG. 4A.

Other embodiments are within the following claims. For example, referring to FIGS. 4A, B, C, lasting board 26 with extensions 30 is secured to an upper 28 by stitching 44 along feather edge 32 before inserting last 36. This alternative attachment of the upper and lasting board prior to sole attachment does not alter the useful performance of the lasting board extensions as anchor points for finings and accessories.

Figures 5A, 5B, 5C:
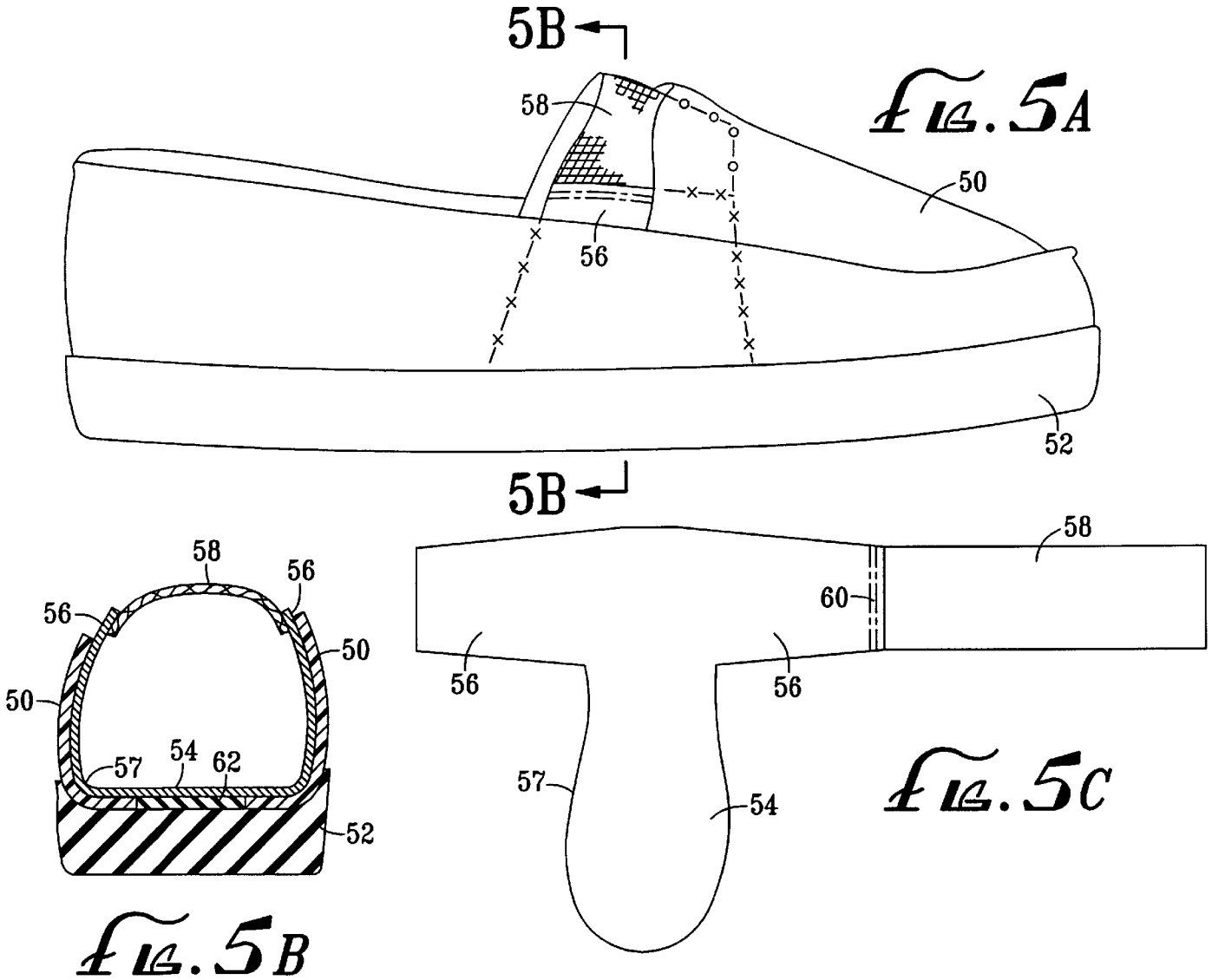
FIG. 5A is an isometric side view of a shoe having a lasting board with extensions.
FIG. 5B is a cross-sectional view taken at W in FIG. 5A.
FIG. 5C is a bottom view of the lasting board of FIG. 5A prior to attachment off the upper and sole.

Referring to FIGS. 5A, B, C, an upper 50 and sole 52 are attached to a partial lasting board 54 with extensions 56, and feather edge 57, used to anchor a strap of elastic material 58 by stitching 60. A filler material 62 is used to fill any space between sole 52 and lasting board 54. This illustrates the useful invention of extensions from the lasting board regardless of the lasting board being partial or fully fitting between the feather edges of the last.

Figure 6A:
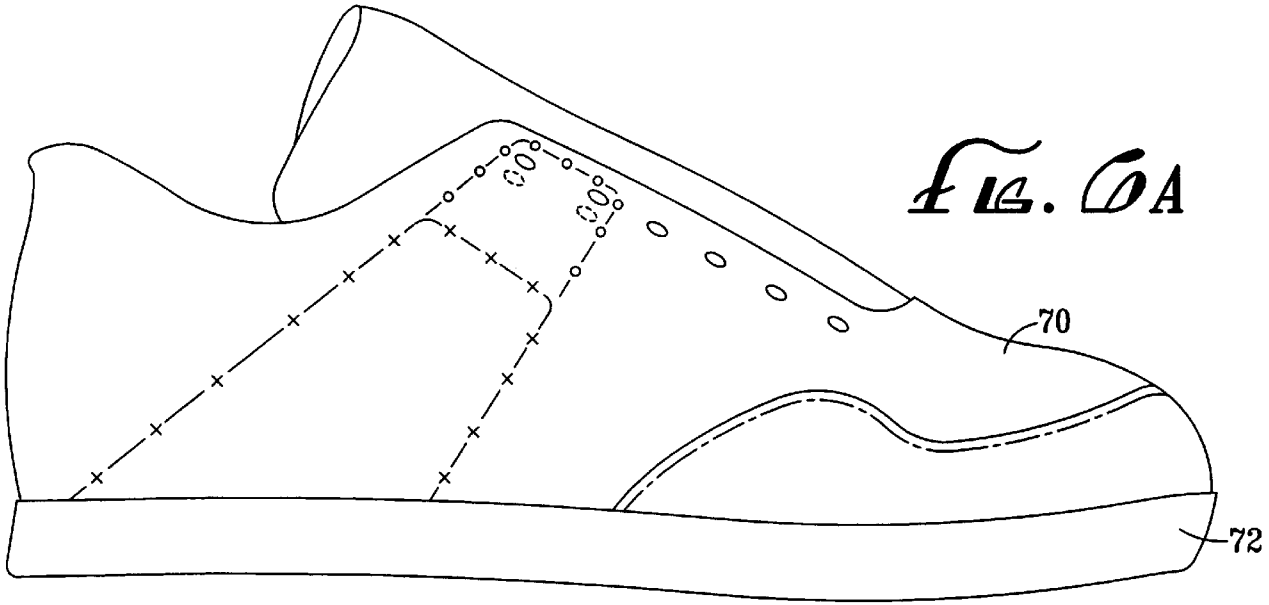
FIG. 6A is an isometric side view of a shoe having a lasting board with an extension.
Figure 6B:
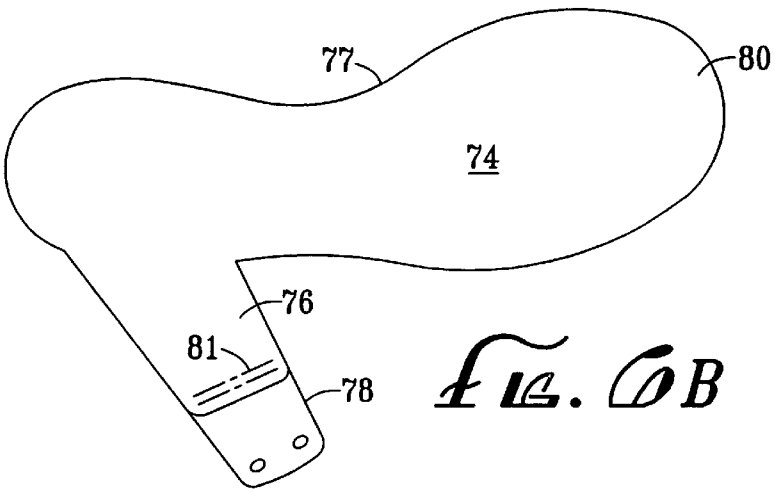
FIG. 6B is a bottom view of the lasting board of FIG. 6A prior to attachment of the upper and sole.

Referring to FIGS. 6A, B, an upper 70 and sole 72 are attached to a lasting board 74 with a single extension 76 beyond feather edge 77 and an eyestay section 78 is attached by stitching 81. The accessory of the eyestay section 78 may be added before the upper 70 and sole 72 are attached to lasting board 74, after upper 70 is attached to lasting board 74 but prior to attachment of sole 72 or after upper 70 and sole 72 have both been attached to lasting board 74. The order of construction will not affect the useful nature of extensions from the lasting board as anchor points. The use of stitching 81 is one of many possible methods for attachment of finings and accessories to lasting board extensions 76. Other methods include cementing, riveting, radio welding, solvent bonding, nailing, direct injection, vulcanizing or stapling. Any number of lasting board extensions 76 may be usefully formed as anchor points.

Figure 7A:
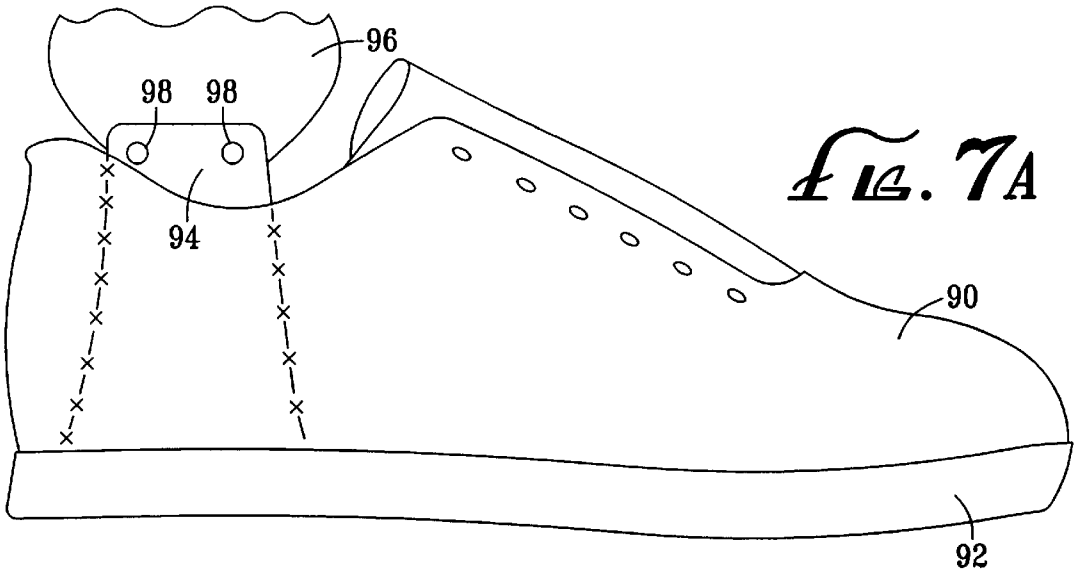
FIGS. 7A–7B are isometric side views of shoes featuring various other embodiments of lasting board extensions useful in the invention.
Figure 7B:
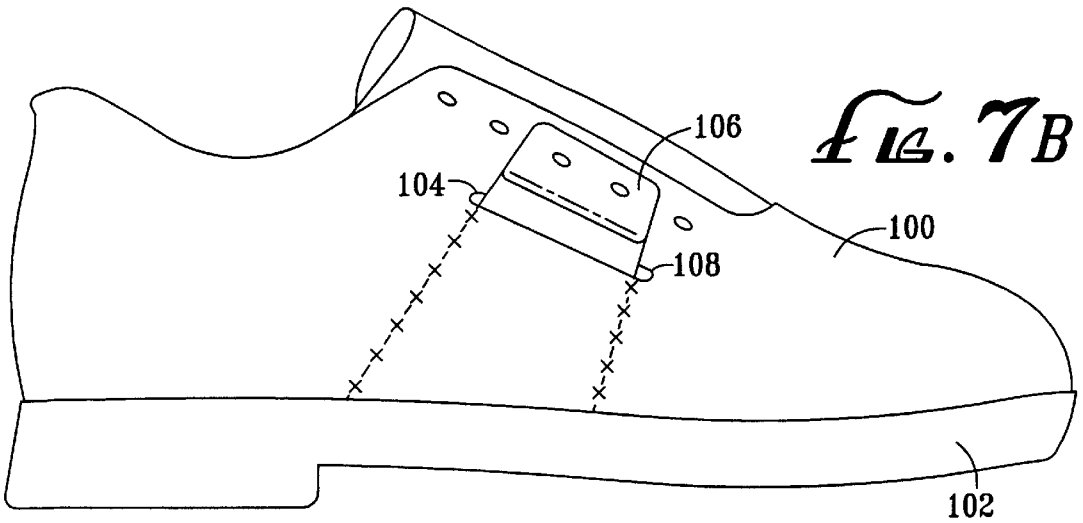

Referring to FIG. 7A, an upper 90 and sole 92 are attached to a lasting board with side extension 94 that is used to anchor a molded plastic ankle brace 96 by rivets 98. Using lasting board extensions to anchor ankle stabilizing components will increase the usefulness of the stabilizers since there will be linking of forces to both the sole and the upper. Referring to FIG. 7B, an upper 100 and sole 102 are attached to a lasting board with an extension 104 and anchored eyelet section 106 threaded through a slit 108 in upper 100. Removing parts of the upper or forming it in a way to make the exposed ends of the lasting board extensions more accessible as anchor points will not affect the usefulness of the invention.

Figure 8:
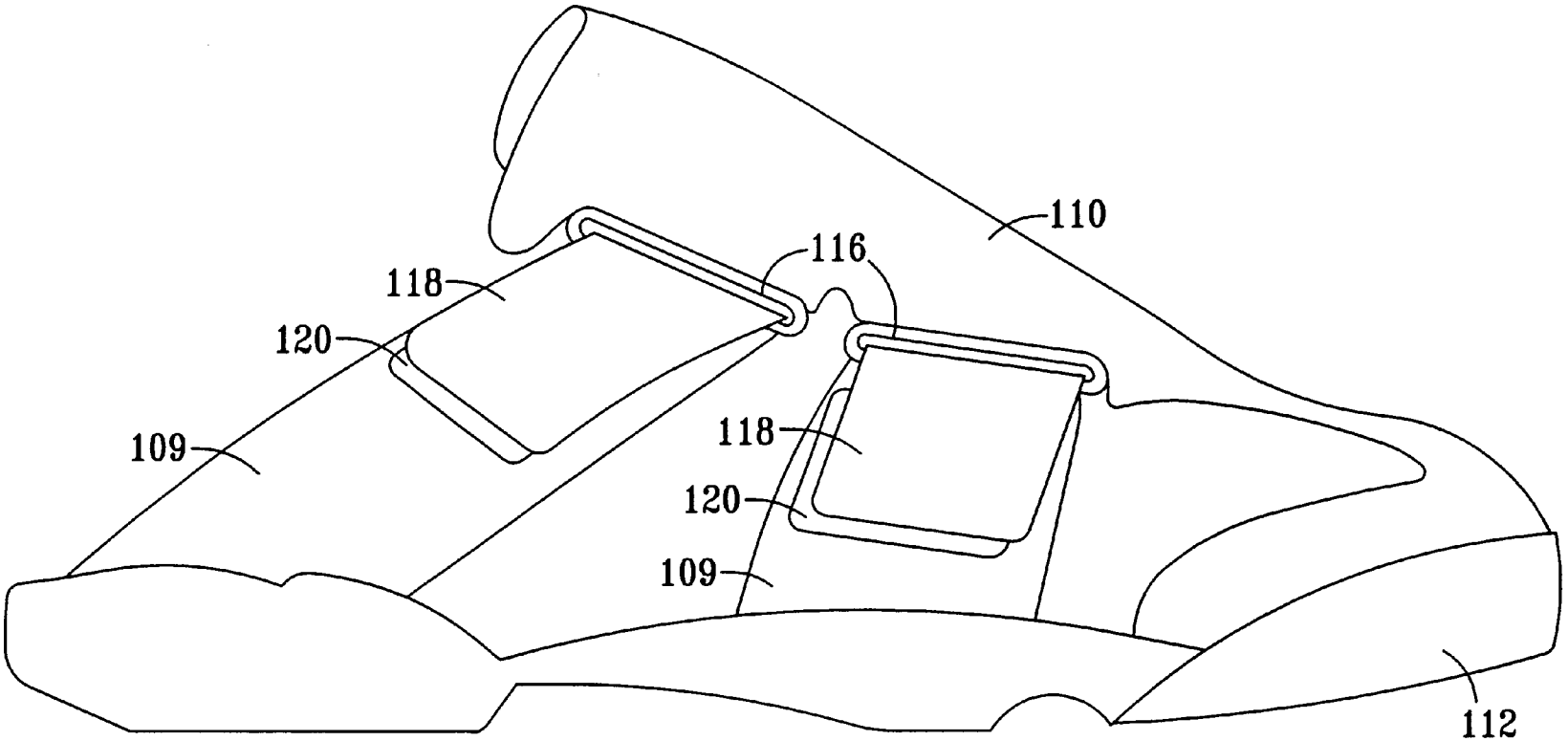
FIG. 8 is a diagrammatic representation of an embodiment of a lasting board useful in the invention.

Referring to FIG. 8, a lasting board with extensions 109 has an upper 110 and a sole 112 attached. Part of upper 110 is not shown to clarify the structure. Extensions 109 of the lasting board are passed through loops 116 and the distal sections 118 are reflected and secured with Velcro® 120. This illustrates the direct application of the lasting board extensions as straps when they are used to anchor VELCRO® fasteners, or other closure devices.

Figure 9:
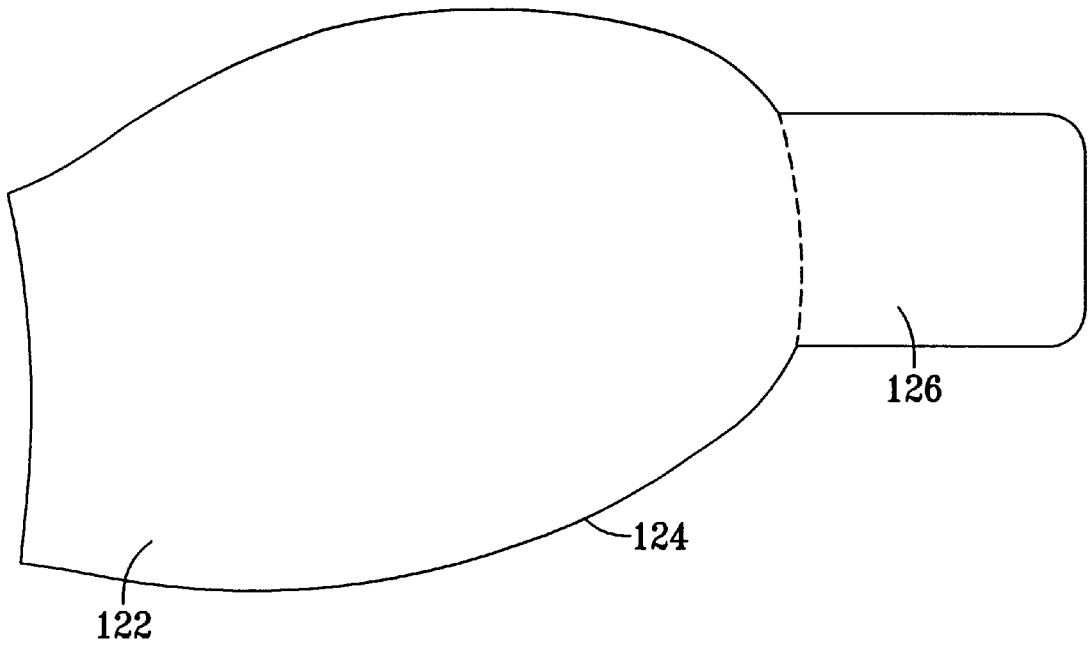
FIG. 9 is a diagrammatic representation of lasting board 122 with extension 126 beyond the feather edge 124.

Referring to FIG. 9, a forefoot partial lasting board 122 has a feather edge 124. An extension 126 is formed from the toe or the lasting board 122 for the attachment of upper components or straps which are not shown.

Figure 10:
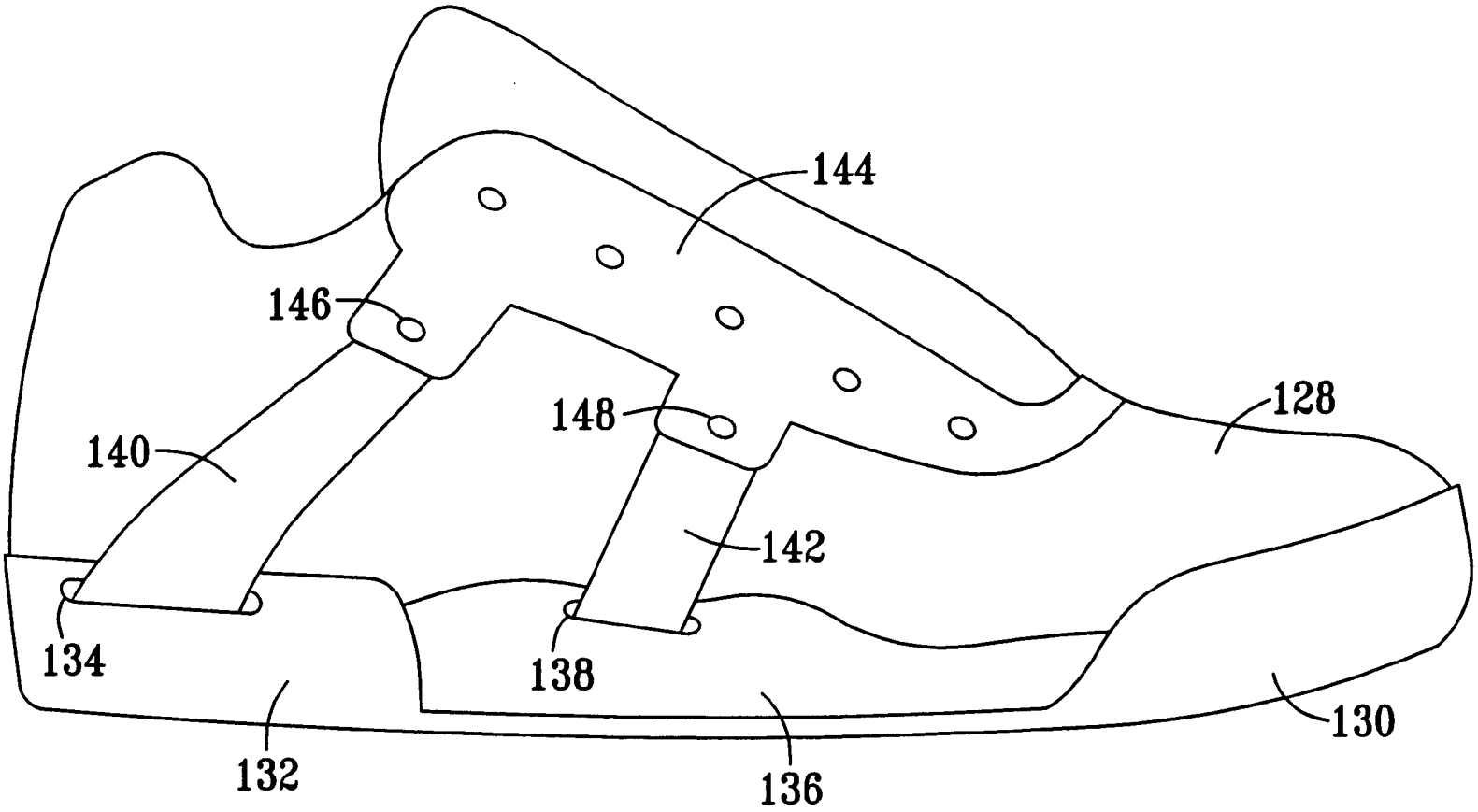
FIG. 10 is an isometric side view of a shoe having an embodiment of the lasting board extensions useful in this invention.

Referring to FIG. 10, an upper 128 is attached to a sole 130 which includes a cup wall 132 and a midsole 136. Extension 140 from the lasting board, not visible, is passed through an opening 134 in the cup wall 132 for attachment of eyestay 144 by a rivet 146. Extension 142 from the lasting board, not visible, is passed through an opening 138 in the midsole 136 for attachment of eyestay 144 by a rivet 148.

Other embodiments are within the following claims.

What is claimed is:

1. A method of making an article of footwear comprising the steps of:

(a) providing an upper;

(b) providing a sole;

(c) providing a lasting board of flexible material having a coextensively formed extension protruding at least 3 mm beyond a feather edge of the lasting board;

(d) fixing the lasting board between the upper and the sole manufactured by a method selected from the group consisting of California slip lasting, flat lasting, and Moccasin construction; and (e) fixing at least a portion of the upper to the extension of the lasting board.

2. The method of claim 1, wherein said fixing of at least a portion of said upper to said extension of said lasting board is by stitching.

3. The method of claim 1, wherein said fixing of at least a portion of said upper to said extension of said lasting board is by cementing.

4. A method of making an article of footwear comprising the steps of:

(a) providing an upper;

(b) providing a sole;

(c) providing a lasting board of flexible material having a coextensively formed extension protruding at least 3 mm beyond a feather edge of the lasting board;

(d) providing an accessory;

(e) fixing the lasting board between the upper and the sole manufactured by a method selected from the group consisting of California slip lasting, flat lasting, and Moccasin construction; and (f) fixing a portion of the accessory to the extension of the lasting board.

5. The method of claim 4, wherein said fixing of a portion of said accessory to said extension of said lasting board is by stitching.

6. The method of claim 4, wherein said fixing of a portion of said accessory to said extension of said lasting board is by cementing.

7. The method of claim 1 or 4, wherein said upper further includes at least a heel area and said lasting board extends only through said heel area of said upper.

8. The method of claim 1 or 4, wherein said upper further includes at least a forefoot area and said lasting board extends only through said forefoot area of the upper.

9. The method of claim 1 or 4, wherein said lasting board and said coextensively formed extension are formed by cutting from a sheet of material.

10. The method of claim 1 or 4, wherein said lasting board and said coextensively formed extension are formed by molding.

11. The method of claim 1 or 4, wherein said lasting board includes more than one said coextensively formed extension.

12. The method of claim 1 or 4, wherein said lasting board and said coextensively formed extension are formed from a stitchbonded textile.

13. The method of claim 1 or 4, comprising the step of fixing said lasting board to said upper by cementing.

14. The method of claim 1 or 4, comprising the step of fixing said lasting board to said upper by stitching.

15. The method of claim 1 or 4, comprising the step of fixing said sole to said lasting board by injection.

16. The method of claim 1 or 4, comprising the step of fixing said sole to said lasting board by cementing.

17. The method of claim 1 or 4, comprising the step of fixing said sole to said lasting board by stitching.

18. The method of claim 1 or 4, comprising the step of providing an opening in said sole and passing said extension through said opening in said sole.

* * * * *